US006369312B1

(12) United States Patent
Komatsu

(10) Patent No.: US 6,369,312 B1
(45) Date of Patent: Apr. 9, 2002

(54) METHOD FOR EXPRESSING VIBRATORY MUSIC AND APPARATUS THEREFOR

(75) Inventor: Akira Komatsu, Tokyo (JP)

(73) Assignee: Acouve Laboratory, Inc., Tokyo (JP)

( * ) Notice: Subject to any disclaimer, the term of this patent is extended or adjusted under 35 U.S.C. 154(b) by 0 days.

(21) Appl. No.: 09/660,443

(22) Filed: Sep. 12, 2000

(30) Foreign Application Priority Data

Sep. 14, 1999 (JP) ..... 11-260628

(51) Int. Cl.[7] ..... G10H 3/00

(52) U.S. Cl. ..... 84/723; 84/706; 84/600; 84/DIG. 24; 381/150; 381/151

(58) Field of Search ..... 84/600, 626, 629, 84/662, 701, 706, 723, 725, 730, DIG. 24; 381/150–151

(56) References Cited

U.S. PATENT DOCUMENTS 4,750,208 A * 6/1988 Yamada et al. ..... 381/151
5,166,463 A * 11/1992 Weber ..... 84/600
5,192,823 A * 3/1993 Suzuki et al. ..... 84/600
5,321,763 A * 6/1994 Lee ..... 381/199
5,553,148 A * 9/1996 Werle ..... 381/151
5,853,005 A * 12/1998 Scanlon ..... 381/150
6,104,820 A * 8/2000 Soza ..... 381/151

* cited by examiner

*Primary Examiner*—Marlon T. Fletcher
(74) *Attorney, Agent, or Firm*—Nath & Associates PLLC; Gary M. Nath; Marvin C. Berkowitz

(57) ABSTRACT

A method for expressing a vibratory music that may be felt as a piece of music for a human being in according with an acoustic vibration in an auditory region and/or a body sensible vibration or a body sensible acoustic vibration and an apparatus therefor are obtained. A signal about 16 Hz to 150 Hz (sound compass C0 to D3) in a frequency band of a body sensible vibration is used and what is composed and arranged in combination of strength, length, frequency, waveform and overlap of the vibration on a time basis, based upon a constant theory is expressed as a vibratory music. Transducers 5 are assembled into a backrest, a seat portion and a leg portion of a reclining seat, respectively. Speakers are mounted on a head portion. The transducers for outputting the sound vibrations are provided on both arm rests. It is possible to hear the sound output from the speakers and simultaneously feel the body sensible vibration by the body (back, hips, legs) by the two transducers and to obtain the sound vibration with the finger tips.

14 Claims, 13 Drawing Sheets

2. AIR

METHOD FOR EXPRESSING VIBRATORY MUSIC AND APPARATUS THEREFOR

BACKGROUND OF THE INVENTION

1. Field of the Invention

The present invention relates to a method for expressing a piece of music in accordance with a vibration or acoustic vibration that can be felt and sensed by a human being's body and/or an acoustic signal in an audio range and an apparatus therefor.

2. Description of the Related Art

The "vibratory music" in the description of this specification means a type of music composed, in combination, of an acoustic sound (sound) in the audio range and a body sensible vibration according to a specified frequency (hereinafter referred to as vibratory music S) or composed solely of the body sensible vibration according to the specified frequency (hereinafter referred to as a vibratory music V). Also, the "body sensible acoustic vibration" means the vibration whose low sound portion is converted into a body sensible vibration so that it may be sensed by a body, out of sound signals that should be heard through a speaker (headphone, earphone or the like). The "body sensible vibration" means the vibration, which is felt by the body in a tangible vibratory manner and in the range of about 16 to 150 Hz to be used mainly as the vibratory music. The "acoustic sound (simply sound)" means an acoustic wave in the range of 20 Hz to 20 kHz of the sound signal such as apiece of music emitted from the speaker. Furthermore, the "sound vibration" means the vibration in the range of 20 Hz to 20 kHz given to tip fingers in the tangible vibratory manner as a replacement/assistant means for the acoustic sensation for the audio sense handicapped people. However, inherently, it means what is converted from the sound signal to be emitted as a sound by the speaker or the like into the vibration normally in the full range. Furthermore, the "vibration transmitting medium" in the description of the specification refers to what transfers to the body the vibration generated from a transducer, or the transducer itself, and includes a chair on which the transducer is mounted, furniture such as a bed, a floor or a receiver tool that may be held by a hand.

When the human being hears sound, it is known that he or she may sense a sound wave transferred through the air and the vibration (bone conduction or the like) sensed by the body through the transmission to the inherent substance. In this connection to "the human being senses the vibration", its origin is derived from his or her embryo. Also, it is known that if he or she senses the similar embryo sound as vibration, this is effective for curing the mental aspect even when he or she grows up through the growth and development of his or her mind and body. Also, it is studied that the psychological and physiological effect individually occurs according to a variety of body sensible acoustic vibrations.

In view of the above-described studies of the body sensible acoustic vibrations, the present inventors have found that if the "auditory sense vibration psychology and physiology and effects thereof" are applied, although those according to the body sensible vibrations are different from the normal music, there is a possibility of expressing like a piece of music according to a vibration in a certain sense. Then, the vibratory music herein after referred to as "Visic" using the body sensible vibration as the medium has been proposed. The Visic is art according to the body sensible vibration and expresses beauty appealing the tangible vibration sense of the body in combination with the body sensible vibration based upon a constant theory such as strength, length, frequency, waveform, overlap and the like of vibration. In comparison with the conventional music, a factor for working to the physiologic sense of the human being is remarkable in the vibratory music, Visic, and it is easy to obtain a sense of relaxation, ecstasy or intoxication. Also, a rate for appealing to the root of the human being is high.

The present invention relates to a system for enjoying and manufacturing the Visic, i.e., a method for body sensing the vibration as the Visic and an apparatus for the Visic.

The body sensible acoustic apparatus means a listening system for a piece of music while feeling the vibration to the body by converting mainly a low sound component of the piece of music into the body sensible acoustic vibration through the transducer simultaneously with the sound on the basis of the bone conduction theory by Dr. Hideo Itokawa.

Then, a number of clinical cases according to a passive musical and medical treatment according to the body sensible acoustic apparatus (for example, called a trade name "Body Sonic" are reported in the medical field such as a psychological internal region, an aged people medical region, a hospice medical region, an artificial dialysis, a component blood transfusion, a surgical region, a dental region or the like.

The effect of the body sensible acoustic vibration to the brain is different according to which part of the body receives the vibration. In view of relaxation, the effect is remarkable in the case where the body sensible acoustic vibration is applied to the entire body. On the other hand, in the case where the language is identified according to the vibration, the finger tips are most excellent in the identification ability and it is known that the language identification ability may be obtained by applying the vibration to the finger tips (For instance "a Velbo-tonal System" by Prof. P. Guberina of SUVAG Center in Zagreb Univ.). This method is suitable for identification of the language but it is impossible to obtain the comfort, intoxication or relaxation effect. Namely, in vibrations, there are also a left brain vibration and a right brain vibration.

In the conventional researches, the main subject is the distinction ability of the vibrations and the identification ability and it is reported that the fingertip portions are most sensitive in the tangible vibration sense of the vibration. However, these researches lack the observation of the effect of the intoxication or relaxation accompanied with the body sensible acoustic vibration.

The transducer as the body sensible acoustic apparatus is a device for translating an audio signal into a vibratory output. In its appliance, in order to cause the transducer to come into contact with the body, the device is installed in a chair, a bed, a floor or the like.

In the case where the transducer is fixed to the floor surface and driven, a movable coil mounted on a case of the transducer is vibrated so that the vibration is outputted to the case. As a result, the vibration is transmitted to the floor surface on which the case of the transducer is mounted. If the user stands on the floor surface, he or she may feel from his or her feet in a body feeling manner. In this case, since a rhythmical signal is inputted into the transducer, it is possible for the user to feel the dynamic vibration from his or her feet.

Also, in the case where the transducer is installed in a chair for spectators in a movie theater, an acoustic sound is outputted from speakers in conformity with the context projected on the screen and simultaneously therewith, the low sound component of this acoustic sound is converted into a signal for the mechanical vibration so that the chair on which the spectator seat himself or herself is vibrated in accordance with this signal. If the condition of the audio signal is met, it is possible to enhance the reality of the documentary sound such as an explosion sound accompanied with the shock sense or rumbling of the ground.

On the other hand, in some cases, in a specific method for using the body sensible acoustic vibration, the transducer is installed in a reclining seat installed in a quiet room, and the vibration of the transducer is transmitted to the body of the user who sit on the reclining seat. In these cases, a signal to be inputted into the transducer is an audio signal such as a piece of music or an electronically synthetic signal. This is applied selectively to the user in conformity with his or her mental and physical conditions. For instance, the relief or intoxication of the user is accelerated according to the body sensible acoustic vibration to ensure the mental and physical relaxation.

Also, it is available to assemble the transducer into a bed. In this case, the transducer is vibrated in accordance with the sleeping signal for inducing the sleep and the transducer may be vibrated in accordance with a wakeup signal for waking up. Also, the body sensible acoustic vibration for assisting the life style has been electronically composed.

In order to ensure the above-described effects, the vibration of the low frequency sound, i.e., the body sensible acoustic vibration is effective. In the popular music for which an electronic instrument or an electric instrument such as an electric bass or a synthesizer is frequently used, the function of the body sensible acoustic device may be used suitably because of the increased opportunity to use the low frequency components. However, in a classical music, which is frequently used for the musical medical treatment, an insufficient amount of the low frequency components is included unlike the case of the popular music. Accordingly, it is difficult to well exhibit the function of the body sensible acoustic device.

This is due to the characteristics of the acoustic musical instrument. In general, a small amount of the basic wave components is included in the frequency component of the generated sound. According to certain data, in the case where the sound of 41 Hz (E1) is generated from a contrabass that is a typical one of the low frequency musical instrument, 41 Hz of the basic wave is lower by 16 db (1/40) than 123 Hz of the third overtone. Also, this is lower by 10 db (1/10) than 82 Hz of the second overtone. If the music is played at 41 Hz in accordance with the musical notation, the amount of the component of 41 Hz of the sound is very small actually. In case of a fagot that is a low frequency music instrument of a woodwind instrument, this tendency is more conspicuous.

Also, in the conventional music, the effect is not remarkable because the frequency of appearance of the sound range of 50 Hz or below is low in general.

Furthermore, in a chamber music such as a string quartet, the low frequency instrument is a cello and the contrabass is not used. Accordingly, the appearance of the low frequency region is small, and the sufficient effect is not obtained. In an extreme case, in the solo music without any accompaniment, such as violin or flute, it is impossible to ensure the effect of the body sensible acoustic vibration.

Thus, in the classical music, in many cases, it is impossible to attain the effect of the sufficient low frequency components. It is therefore difficult to well enjoy the function of the body sensible acoustic device in case of the classical music.

As described above, the signal for the body sensible vibration to be inputted into the transducer of the body sensible acoustic apparatus is a low frequency portion of an audio signal such as music or an electronically synthesized signal. These signals are not simple physical signals. The body sensible acoustic vibration including the information affecting the psychological and physiological effects is felt by the body, to thereby utilize the effective advantage such as reality, relaxation and mental assist.

By the way, if it is possible to affect the corresponding psychological and physiological effect in accordance with a variety of vibration signals for various purposes, it is expected that the change in shift of the psychological and physiological effect occurs by the combination of the vibration signals, and it is possible to impart a certain kind of "emotional expression". This means that there is a possibility of propagating the expression like a piece of music by the body vibrations.

However, conventionally, in music composed to be listened to by ears, not any attention is paid to the body vibrations. Accordingly, in case of such a sound source, as mentioned before, in many cases, it is impossible to obtain sufficient body sensible vibration output according to the acoustic characteristics of the instrument used.

Accordingly, it is desirable that "Visic" impart change of expectation of expression likening a piece of music to body sensible vibration thus producing body sensible vibration as an indispensable factor. Primarily, it is possible to enjoy Visic that uses body sensible vibrations as the indispensable factor together with the acoustic effect, and therefore the psychological and physiological effect and the acoustic effect causes synergy.

The body sensible vibrations in the sound range of 16.351 Hz ($C_0$) to 48.999 Hz ($G_1$) out of the range of about 16 Hz to 150 Hz used in the body sensible vibration have a high effect to cause the physiological comfort, deep ecstasy or intoxication. However, in the body sensible acoustic apparatus using the conventional transducer, it is difficult to reproduce the frequency of 40 Hz or less.

SUMMARY OF THE INVENTION

An object of the present invention is to provide a method in which all sound compass that is defined by a musical sound, in particular, a low frequency region is used, and the "vibratory music" (Visic) that has a new possibility of expression may be enjoyed through an transducer and a vibratory music apparatus therefor.

Another object of the present invention is to provide a method for expressing a vibratory music by using an transducer using a body sensible vibration in a sound compass of about 16 Hz to 150 Hz in which the effect to cause the physiological comfort, deep ecstasy and intoxication is high, particularly in 16.351 Hz ($C_0$) to 48.999 Hz ($G_1$), and a body sensible acoustic apparatus therefor.

In order to attain these and other objects, according to a first aspect of the invention, there is provided a method comprising the following steps of: using a signal about 16 Hz to 150 Hz in a frequency band of a body sensible vibration; and expressing as a vibratory music what is composed and arranged in combination of strength, length, frequency, waveform and overlap of the vibration on a time basis, based upon a constant theory. Here, the constant theory means a rule of musical composition such as musical scale, harmonics, rhythm or the like.

The frequency band of the body sensible vibration in the vibratory music is in the range of 16 Hz to 150 Hz. However, the body sensible vibration in the musical compass of 16.351 Hz ($C_0$) to 48.999 ($G_1$) out of this range has remarkable effects for deep ecstasy, intoxication and relaxation.

According to a second aspect of the invention, there is provided a method for expressing a vibratory music, comprising the following steps of: composing and arranging an acoustic signal in an auditory range and a vibration causing the user's body to feel through an transducer or vibration transmitting media of the transducer what is assembled on a time basis on the basis of a constant theory out of strength, length, frequency, waveform and overlap of a vibration, using a signal of about 16 Hz to 150 Hz in a frequency band of a body sensible vibration; and causing the user to feel what is composed and arranged as an acoustic sound (sound) from his or her auditory sense and the body sensible vibration.

The frequency band of the body sensible vibration in the vibratory music is in the range of 16 Hz to 150 Hz. However, the body sensible vibration in the musical compass of 16.351 Hz ($C_0$) to 48.999 ($G_1$) out of this range has remarkable effects for deep ecstasy, intoxication and relaxation and hence it is particularly important. However, since only with the frequency of 16.351 Hz ($C_0$) to 48.999 ($G_1$), there is a fear that the expression is biased or monotonous, it is important to use various combination of the frequency and contrast for the article.

In order to facilitate the production of the vibratory acoustic sound using the above described compass, the specialized equipment or software is required. It is however possible to use a software or a hardware of current DTM (desk top music) for the time being.

According to a third aspect of the invention, a vibratory music apparatus comprises an transducer for transmitting a body sensible vibration in the range of about 16 Hz to 150 Hz to the human body.

This vibratory music apparatus is an apparatus for embodying the expression method of the vibratory music according to the first or second aspect of the invention. The vibration transmitting medium requires the transducer that may reproduce the signal down to 16 Hz. (In the state of the art, it is impossible to attain this with devices other than Vibrotransducer Vt7 (Trade Name) developed by the present applicant.) The transducer may be assembled into various furniture such as a chair, a bed or a handy container that may come into contact with the body. Also, it is possible to operate each transducer in accordance with the musical signal separated in a plurality of systems.

According to a fourth aspect of the invention, a vibratory music apparatus comprising: an transducer for transmitting a body sensible vibration in the range of about 16 Hz to 150 Hz to the human body; and an acoustic reproduction device in which a sound signal in the range of 20 Hz to 20 KHz is reproduced by speakers, and therefore, the user may appreciate simultaneously both the body sensible vibration and the acoustic sound (sound).

The body feels simultaneously the body sensible vibration and the acoustic sound (sound) from the speakers or the like to thereby enhance the effect for imparting the ecstasy, intoxication and relaxation to the body.

According to the fourth aspect of the invention, it is possible to make the musical sound, into which the sound in the vicinity of C0 to D3 of the compass and the auditory sound are mixed, into the mixture signal of the musical signal in the low frequency region and the signal in the sound frequency region, to distinguish the mixed signal in the low frequency region and to output the vibration from the transducer and simultaneously output it to the speakers.

According to the fourth aspect of the invention, by inputting the alternative signal to the movable coil fixed within the case, and by using the transducer for vibrating the case, it is possible to generate the sound in the low frequency region in the vicinity of the compass of C0 to D3, to transmit through the vibration transmitting medium bringing the output vibration into contact with the body during the operation of the transducer , and to cause the body to feel the output vibration. This device may be used for both the auditory handicapped people and the non-handicapped people.

According to a fifth aspect of the invention, in the fourth aspect of the invention, the auditory handicapped people may identify sound in a tangible sensitive manner by the transducer for converting the sound signal reproduced by a speaker into a sound vibration. The movable coil is freely vibrated by using the magnetic circuit as a fixed portion in the transducer for outputting the sound vibration. By the contact with that portion, it is possible to distinguish the sounds. In this case, since the frequency to be handled in the transducer is wide (the type for directly picking up the vibration output of the movable coil is more available but in that case, the magnetic circuit is not suspended through a damper) and the small electric power is needed for the vibration output, the translating device may be different from one for the body sensible apparatus but the translating device for the body sensible apparatus may be used.

DESCRIPTION OF THE PREFERRED EMBODIMENTS

Figure 1:
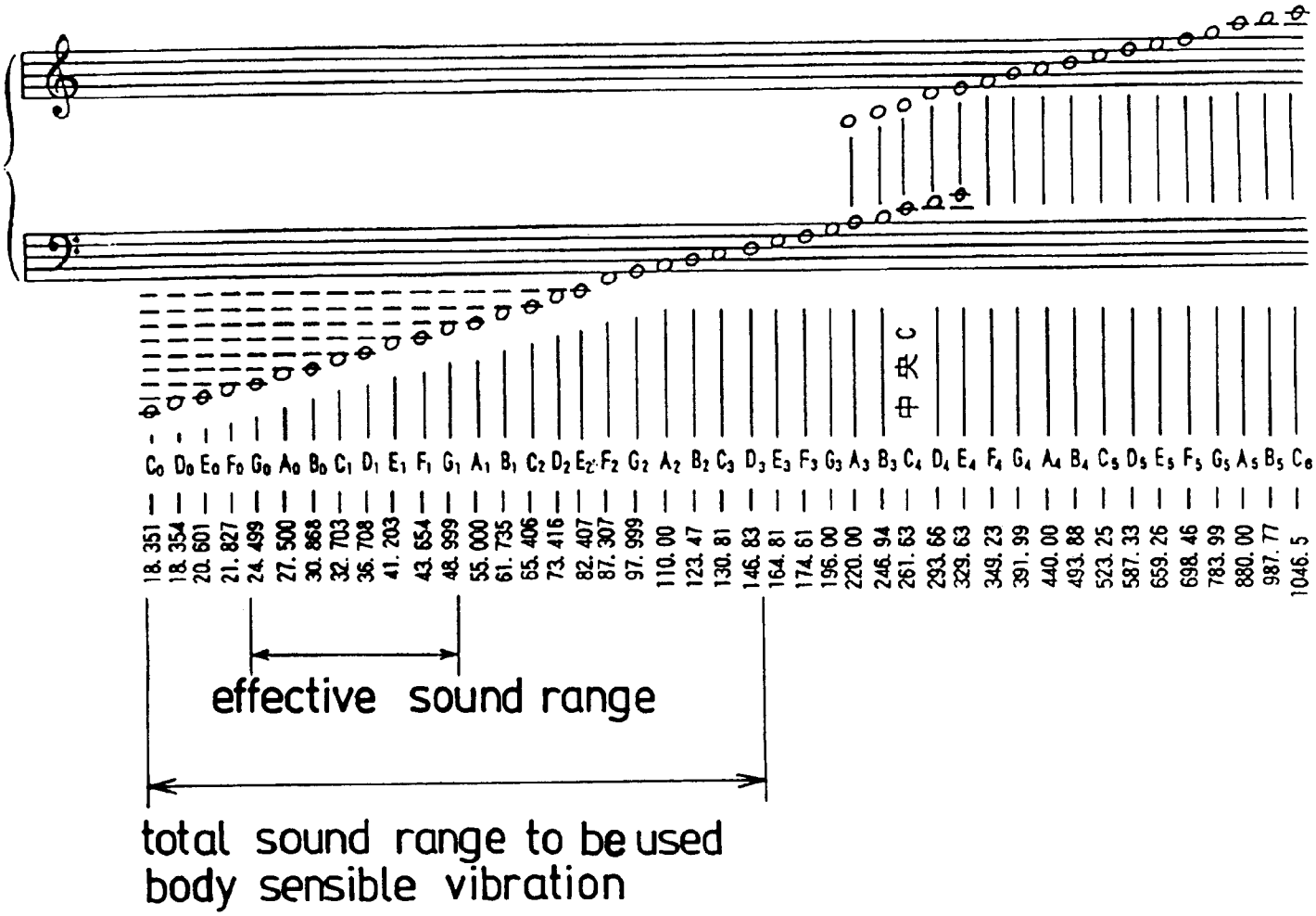
FIG. 1 is a view illustrating a sound compass used in a vibratory music apparatus according to an embodiment of the present invention, showing a sound compass which the vibratory music uses as a body sensible acoustic vibration.

An embodiment of the present invention will now be described with reference to the accompanying drawings. The sound compass of FIG. 1 shows the range used as the body vibrations in the Visic. The body sensible vibrations in the sound range of 16.351 Hz ($C_0$) to 48.999 Hz ($G_1$) out of the range of about 16 Hz to 150 Hz used in the body sensible vibration have a high effect to cause the physiological comfort, deep ecstasy or intoxication.

The Visic is categorized into "what to be formed by sound and vibration" and "what to be formed only by vibration". The higher the factor of the vibration, the more the auditory handicapped people may enjoy the vibratory music, Visic in the same manner for the non-handicapped people. In the system for auditory handicapped people, the signal (20 Hz to 20 kHz) of the sound channel is used and converted into the sound vibration by the transducer and therefore, the identification of the sound is possible by imparting the sound vibration to the finger tips or the like.

For using the transducer as the Visic device, the transducer as means for contacting the body is assembled into furniture such as a chair or bed.

Also, in case of non-handicapped people, the acoustic sound (sound) from their ears is used together with the body sensible vibration. Thus, the vibration sensible effect is enhanced and it is possible to expand the image of emotion. In view of these facts, the structure of the present apparatus will now be described.

The level of sound used in the device for generating the body sensible vibration in a musical fashion is intended to the range of musical notes C0 to D3 as shown in FIG. 1. For example, the musical note C0 corresponds to 16.351 Hz and D3 corresponds to 146.83 Hz. Accordingly, the vibration corresponding to a musical scale between about 16 Hz to 150 Hz, i.e., the vibration having about 3 octave width is driven so that it is possible to compose a piece of music utilizing well the vibrations. Incidentally, by a variety of researches of the relaxation or the like, it is confirmed that the frequency band for ensuring the comfortable vibration sense is in the range of about 25 Hz to 50 Hz. If this is converted into the musical scale, this is about one octave of G0 (24.49 Hz) to G1 (48.99 Hz)

Also, the sound from the ears for the non-handicapped people causes the image to be expanded. It is effective to apply the auditory portion to the user as a musical performance or the output signal. In this case, the sound frequency band (20 Hz to 20 kHz) is used for the auditory range.

Accordingly, the output signal becomes a mixture signal into which the body sensible vibration and the sound in the auditory range are mixed. Therefore, the output signal is separated through a filter upon the reproduction.

Also, it is possible to use a type in which the vibration output is directly applied to the finger tips as a type for receiving the vibratory output of the transducer.

Figure 2:
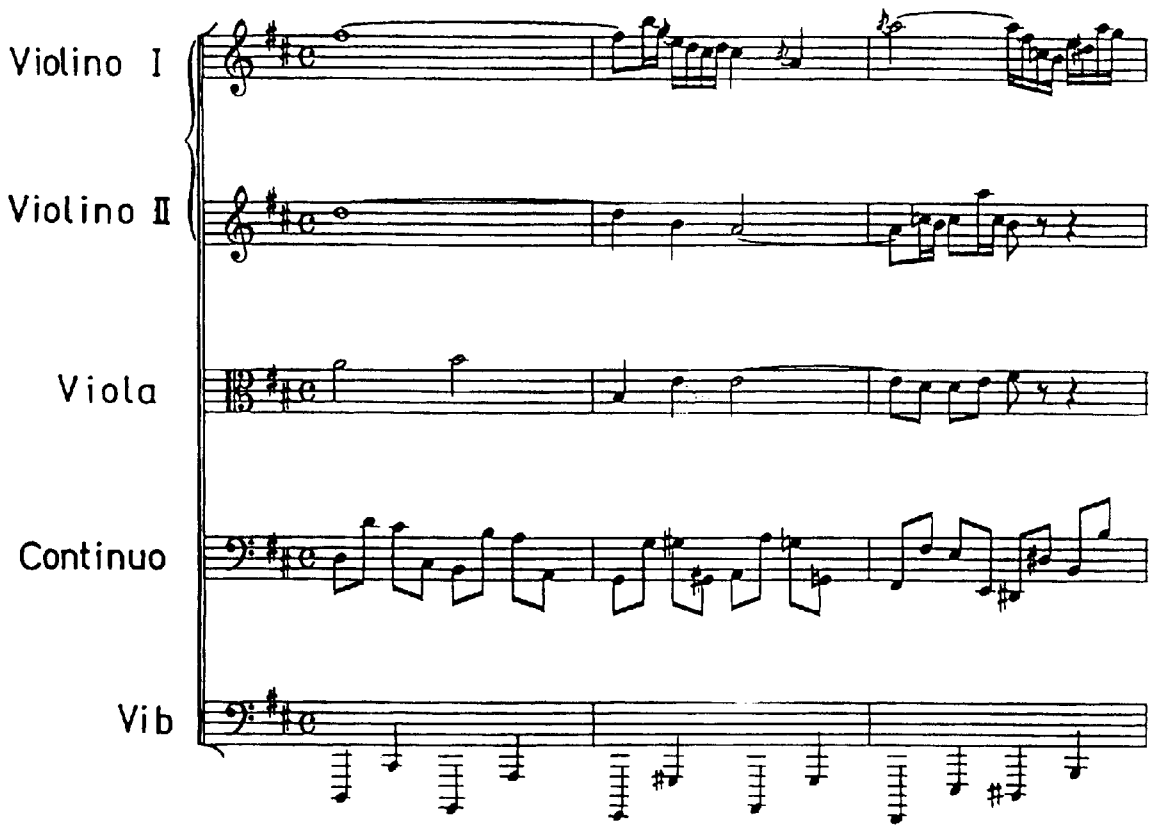
FIG. 2 shows an example of a vibratory music obtained by arranging a piece of conventional music.

FIG. 2 shows an example in which a piece of the conventional music is arranged for the Visic.

FIG. 2 shows an introductory part of aria from a third part of an orchestral suite of Bach. Vib located at the lowermost level of the score is a part for the body sensible vibration. This is obtained by somewhat modifying a music form of a part of Continuo (normal play low sound) to be shifted down by one to two octaves. By making the sound source waveform into a sine wave, a rectangular wave including a high frequency wave or a triangular wave system one, it is possible to exhibit the change corresponding to the selection of the conventional sound tone.

Figure 3:
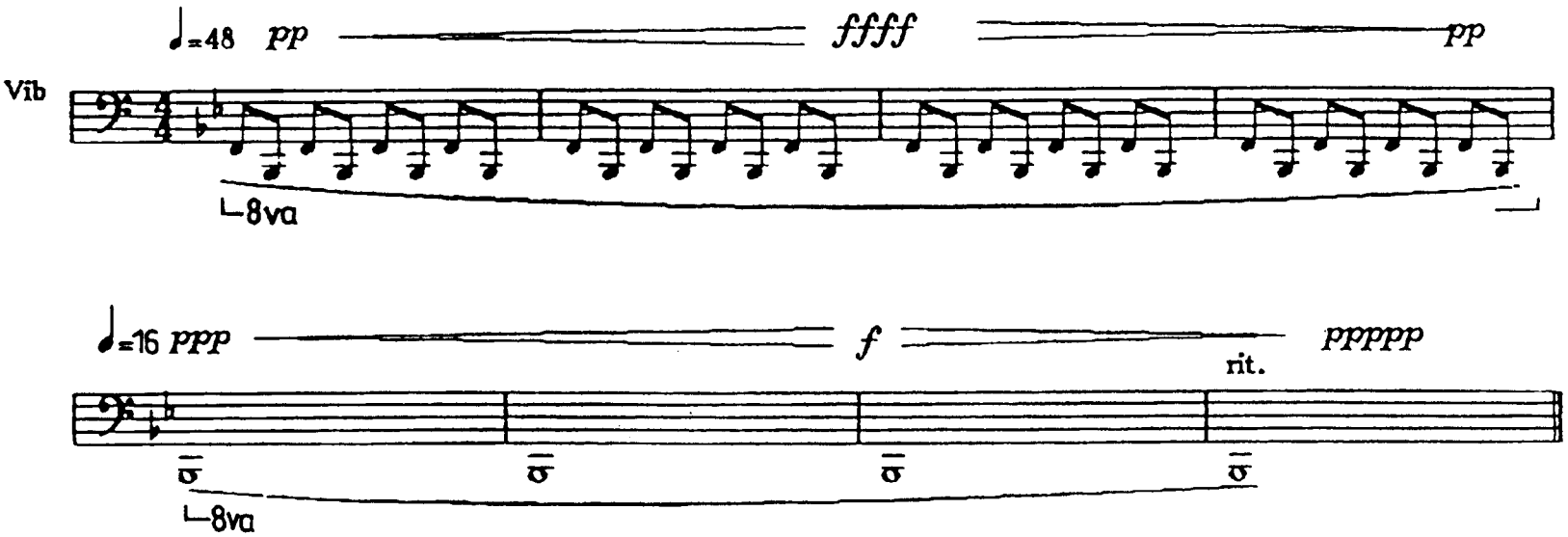
FIG. 3 shows an example of a vibratory music.

FIG. 3 shows an example of music sheet in case of the Visic V. Because of the instruction of 8 va, the actual sound is lower by one octave than the sound on the music sheet. This is suitable for inducing the sleep and the full music is about 30 minutes long. The intermediate portion is omitted in the music sheet shown. After the introduction, the Visic enters the upper level in the sheet of FIG. 6, and the Visic is changed to reduce the speed gradually while the stimulation is weakened so that the consciousness level is lowered for sleep. The music sheet in the lower level indicates the final portion.

It is thus possible to produce the vibration form on the time basis as desired and to express the Visic in accordance with the music sheet. Namely, the vibration in the low sound range that may be enjoyed by the human being according to the present apparatus is generated on the time basis so as to include the expression like music in accordance with the rule of music, so that it may be sensed directly by the body and it is possible to impart a variety of stimulations to the sensitivity owned by the human being.

Also, as described above, the vibratory music is categorized into "what is formed by the vibration and sound" (Visic S) and "what is formed only by the vibration" (Visic V). The more the factor of the vibration, the more equally the auditory handicapped people may enjoy the visic. It is expected that a composer or a player of the visic will appear out of the auditory handicapped people in future. Also, a hardware such as an instrument for producing a vibratory music (like a studio instrument), a play instrument (a kind of electronic instrument) and an appreciation instrument (body sensible acoustic device with the vibratory music specification) will be required, and media having new standards will be also developed. In view of these factors, a new demand will be raised and the economical effect may be expected.

Also, the famous music is arranged for the vibratory music so that the music that exhibits the body sensitive vibration in the lower sound compass may be produced.

The following embodiments are to embody the Visic S and/or Visic V. As to the common features, the range of the body sensible vibration frequency is 16 Hz to 150 Hz (sound range C0 to D3) and the range of the sound frequency is 20 Hz to 20 kHz. In case of the Visic S, in order to impart the sound vibration for the auditory handicapped people, the signal of the sound channel is used in its full range and is converted into the vibration by the transducer to obtain the sound vibration through the vibration transmitting medium from the finger tips.

For the auditory handicapped people, with the Visic S, it is impossible to hear the portion of the "sound (sound wave)" of the Visic. Accordingly, the electric signal of the sound is converted into the "sound vibration" through the transducer for translating the signal in the full range into the vibration. Thus, the vibration is transmitted in a tangible sensitive manner from a vibration output terminal S (see FIG. 5) of the transducer to a finger tip that is the most sensitive portion with the highest vibration distinction ability out of the body to thereby constitute the assist means for obtaining the sound information.

An embodiment in which the device according to the present invention is assembled into furniture or the like will now be described.

Figure 4:
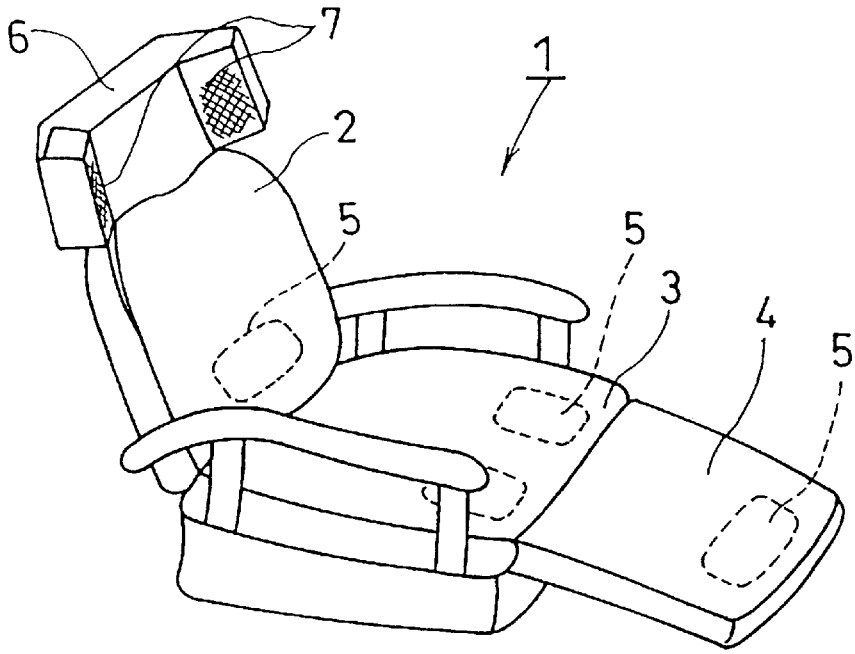
FIG. 4 is a structural view of a reclining seat for body sensing the output vibration of the vibratory music apparatus in accordance with the embodiment of the invention.

As shown in FIG. 4, transducers 5 may be assembled into a backrest 2, a seat portion 3 and a leg portion 4 of a reclining seat 1, respectively. Speakers 7 are mounted on a head portion 6 of the reclining seat 1.

A body sensible vibration signal is inputted into the transducers 5 so that the movable coils are vibrated in the range of 16 Hz to 150 Hz. The vibration is sensed directly by the body of the user (backrest, seat portion and leg portion).

Further, in the example shown in FIG. 4 as the Visic apparatus, the two transducers 5 are used in 1*ch* or 2*ch*, and may be used as 1ch by mixing upon the stereo reproduction. Also, the transducers 5 provided in the seat portion 3 may be set to Rch and the transducer 5 provided in the backrest 2 may be set to Lch to thereby enjoy the 2*ch* system. Incidentally, in the case where the backrest and the seat portion are used for 2*ch*, the leg portion is used as a part of the seat portion.

Also, in the case where the sound and the vibration low sound compass are mixed during the recording, the mixture signal is separated in accordance with a frequency band through a low pass filter of 150 Hz upon the reproduction, and the signal in the low sound compass is inputted into the transducers 5 to thereby make it possible to ensure the effective vibration. The signal on the sound side is inputted into the speakers 7 to output an acoustic sound.

The structure of the transducers for the sound vibration will now be described with reference to FIG. 5. In each transducer E-M for outputting the sound vibration, a magnetic circuit is composed of a yoke Y and a magnet M with a movable coil C fixed to the vibration output terminal S. The magnetic circuit is fixed to an outside case 40 and the vibration output terminal S is fitted to the outside case 40 through a damper D. When the sound signal is applied to the movable coil C, the vibration output terminal S is moved up and down by the movable coil so that the vibration output may be picked up.

Figure 5:
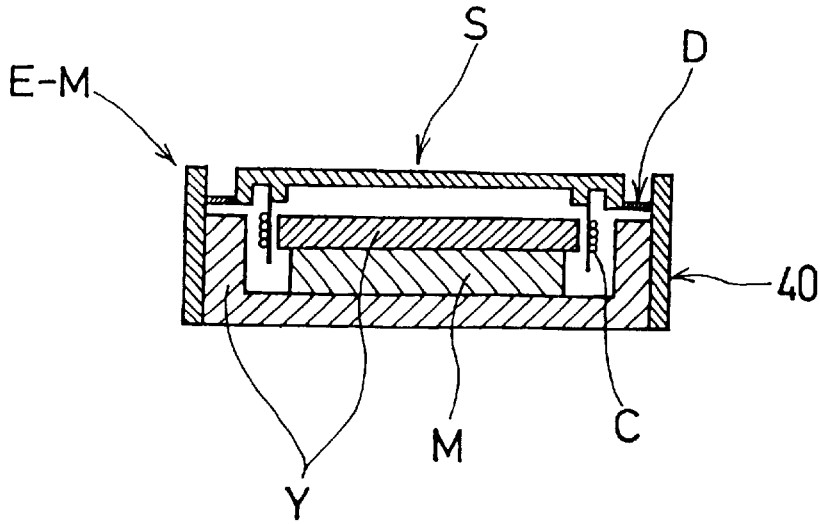
FIG. 5 is a cross-sectional view showing an transducer for outputting he acoustic vibration.
Figure 6:
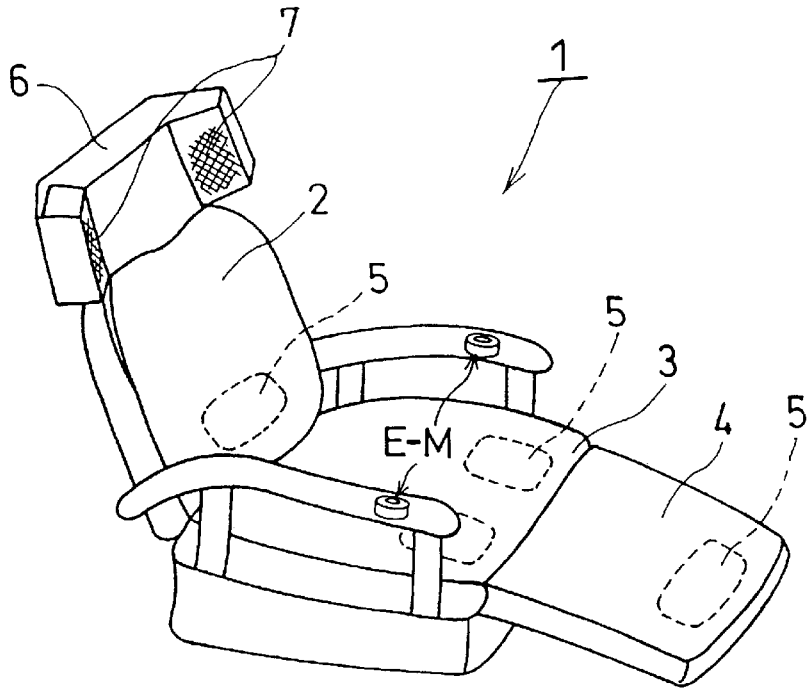
FIG. 6 shows a case where the transducers for outputting the sound vibrations are mounted on both arm rests of the reclining chair shoe in FIG. 4.

FIG. 6 shows an example of the apparatus according to the present invention, which may sense both the acoustic sound (sound) and the sound vibration. This is an apparatus for making it possible also for the auditory handicapped people and the non-handicapped people to appreciate the vibratory music (Visic) S. The transducers E-M shown in FIG. 5 for outputting the sound vibrations are provided in the reclining chair shown in FIG. 4 for obtaining the sound vibration. Its block diagrams correspond to FIGS. 10 and 14. In this case, the transducers E-M are provided on both arm rests of the reclining chair. How to provide them may be suitably selected from bonding, embedding, screwing-in or the like if the vibration output terminal S might be brought into contact with the body. Incidentally, in FIG. 6, a drive source, wirings and the like have been omitted.

Figure 7:
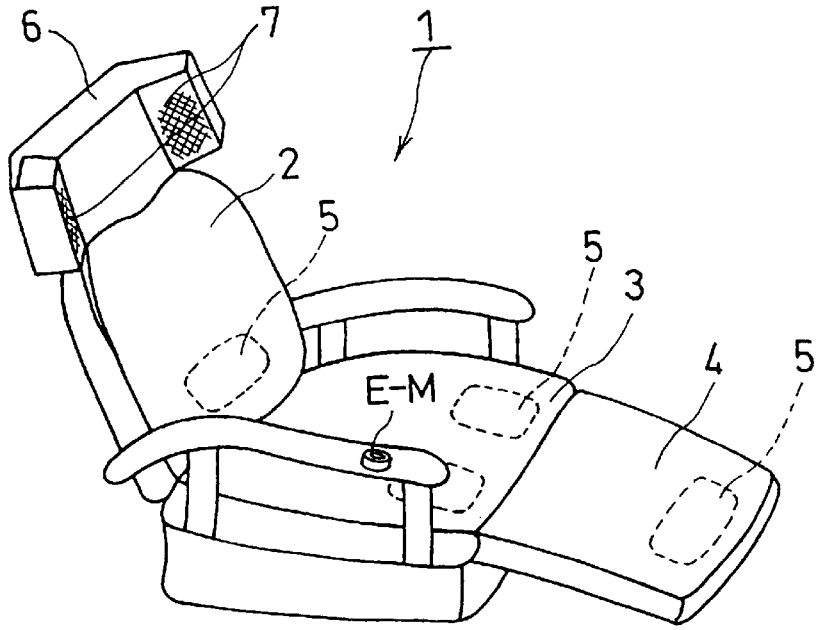
FIG. 7 shows a case where the transducer for outputting the sound vibration is mounted on one of arm rests of the reclining chair shown in FIG. 4.

Also, the device shown in FIG. 7 is used for both the auditory handicapped people and the non-handicapped people in the same manner as in the device shown in FIG. 6 and is an example in which the transducer E-M shown in FIG. 5 for outputting the sound vibrations is provided in the reclining chair shown in FIG. 4. In this case, the transducer E-M is provided on one of the arm rests of the reclining chair. How to provide it is the same as in the case shown in FIG. 6. Its block diagrams correspond to FIGS. 11 and 15.

The reason why the transducer E-M is provided on the right side as shown in FIG. 7 is that if the sound vibration is applied to the right finger tips, the probability that its vibration is transmitted to the left brain is increased to thereby enhance the distinction ability.

In order to embody the present invention, the embodiments are categorized into the following first to fourth cases in accordance with the number of the channels of the body sensible vibration, the recording system of the body sensible vibration and the like.

(Case 1)

The number of the sound channels is two of L and R, the number of channel of the body sensible vibration is one and the recording system of the body sensible vibration is that the body sensible vibration is entered into the channels L and R together with the sound signal. Upon reproduction, after mixing L and R signals, the body sensible vibration signal is picked up through a lowpass filter of $f_c$ 150 Hz.

(Case 2)

The number of the sound channels is two of L and R, and the number of channels of the body sensible vibration is two, i.e., one in the backrest portion of the apparatus and one of the seat portion. However, the backrest is assigned to the L channel of the sound channel and the seat portion is assigned to the R channel of the sound channel. Also, the body sensible vibration signal is applied to the L channel in the backrest and to the R channel in the seat portion together with the sound signal. Upon reproduction, the body sensible vibration signals of the L and R signals are picked up through the low pass filter of $f_c$ 150 Hz, respectively, so that the signal for the L channel drives the backrest and the signal for the R channel drives the seat portion. The body sensible vibration signals are for the two channels of the backrest and the seat portion so that it is possible to express the vibration with an active motion from the seat portion to the backrest and from the backrest to the set portion. Also, it is possible to attain the more active expression such that the lower frequency vibration is in the seat portion and the higher frequency vibration is in the backrest and vise versa.

(Case 3)

The number of the sound channels is two channels of L and R and the number of channels of body sensible vibration is two (independently one for the backrest and one for the seat portion). With the two channels of the backrest and the seat portion for the body sensible vibration signal, it is possible to express the active vibration from the seat portion to the backrest and from the backrest to the seat portion. Also, it is possible to attain the more active expression such that the lower frequency vibration is in the seat portion and the higher frequency vibration is in the backrest and vise versa.

(Case 4)

The number of the sound channels is two channels of L and R and the number of channels of body sensible vibration is four (independently two for the backrest (one for shoulder and one for back) and two for the seat portion (one for hips and one for legs)). Since the body sensible vibration signals are the four channels of the shoulder, back, hips and legs, it is possible to attain the further active vibration expression with a fine motion from the lower half body to the upper half body and from the upper half body to the lower half body. Also, it is possible to attain the more active expression such that the lower frequency vibration is in the leg portion and the higher frequency vibration is in the back portion and vise versa.

EXAMPLE 1

Figure 8:
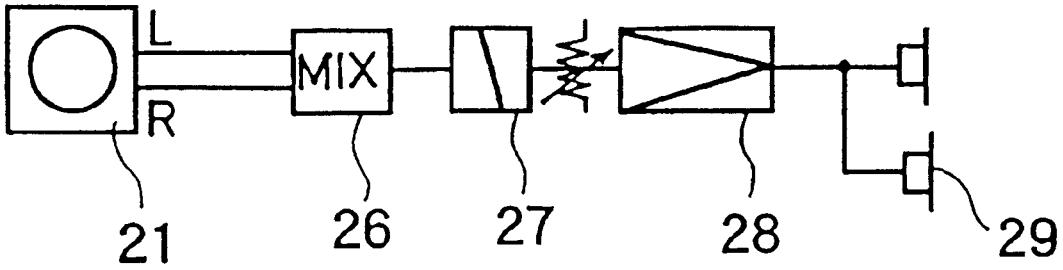
FIG. 8 is a view showing an example of a vibratory music apparatus only according to the body sensible vibration.

FIG. 8 shows a case where the case 1 of the Visic V is expressed by the body sensible vibration output. The outputs L and R from a CD player 21 are inputted into a mixer 26. The range of 16 Hz to 150 Hz (sound range of C0 to D3) is picked up through a low pass filter 27 from the outputs. The body sensible vibration output is obtained by amplifying the signals by an amplifier 28 through volume adjustment. In this case, the Visic V may be appreciated only by the body sensible vibration because the Visic is composed of the body sensible vibration. Incidentally it is possible to dispense with the low pass filter 27.

EXAMPLE 2

Figure 9:
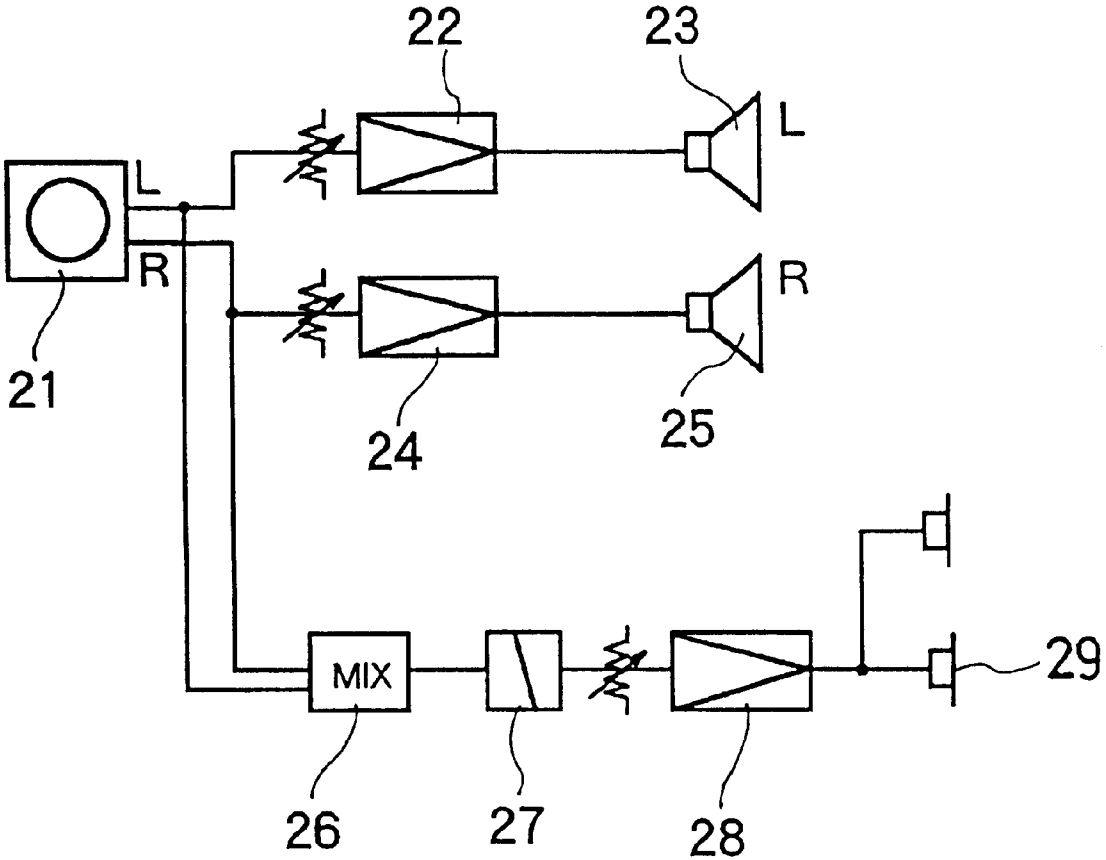
FIG. 9 is a view showing an example of a vibratory music apparatus for expressing a piece of vibratory music in accordance with the/body sensible vibration and the sound output.
Figure 11:
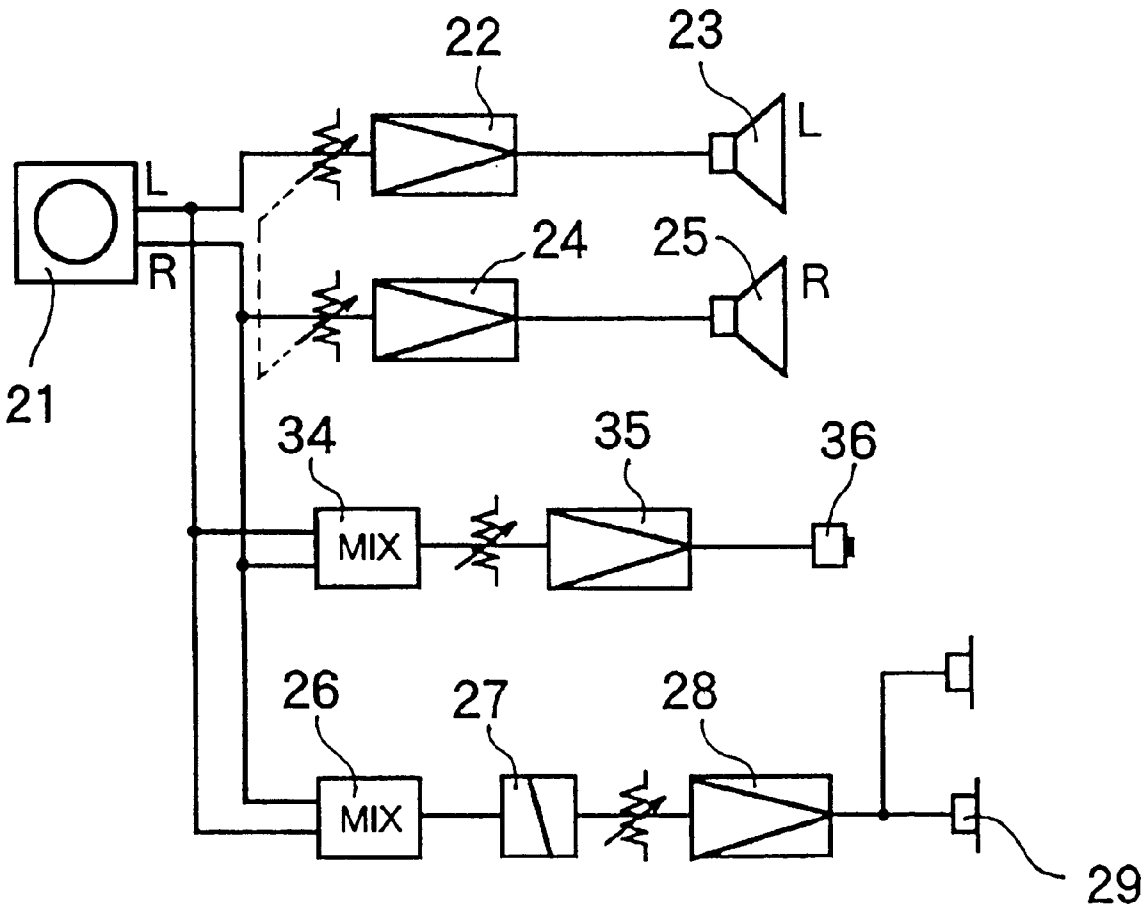
FIG. 11 is a view showing an example of the vibratory music apparatus for expressing a piece of vibratory music in accordance with the body sensible vibration and the sound output, in which two sound channels, one sound vibratory output channel and one body sensible vibration output channel are provided.
Figure 14:
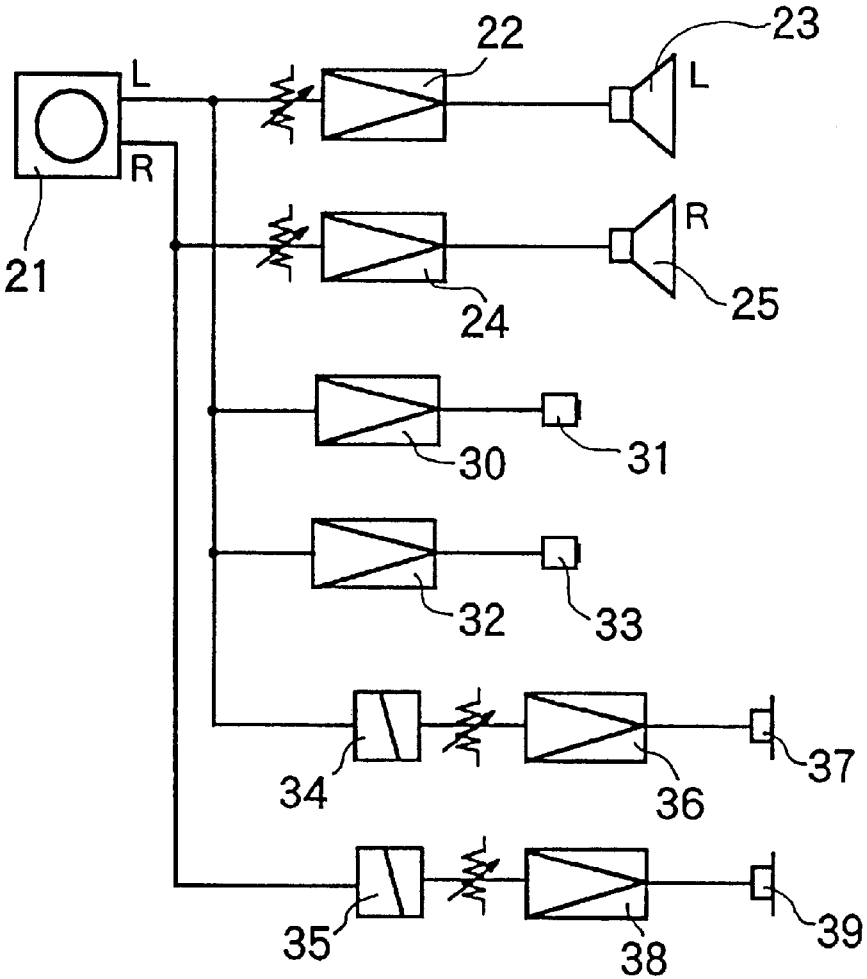
FIG. 14 is a view showing an example of the vibratory music apparatus for expressing a piece of vibratory music in accordance with the body sensible vibration and the sound output, in which two sound channels, two sound vibratory output channels and two body sensible vibration output channels are provided.

Examples 2 to 5 are related to the apparatus of the vibratory music using both the Visic S composed of the body sensible vibration and the sound and the Visic V composed only of the body sensible vibration, corresponding to the case 1. The apparatus shown in FIG. 9 is mainly for the non-handicapped people, and the apparatus shown in FIGS. 11 and 14 are for both the auditory handicapped people and the non-handicapped people. However, according to the extent of the handicap, there is no problem in that the auditory handicapped people use the apparatus shown in FIG. 9.

In FIG. 9, a CD player is used as a sound source 21 but any other device may be used. The outputs L and R from the sound source 21 are amplified through the volume adjustment by the sound amplifiers 22 and 24, respectively, to obtain the sound output in the range of 20 Hz to 20 kHz from speakers 23 and 25. Also, simultaneously, the outputs L and R from the above-described sound source 21 are inputted to the mixer 26. Only the low frequency outputs are picked up by a low pass filter 27 and are inputted into the amplifier 28 through the volume adjustment. The output is inputted into an transducer 29 to obtain the body sensible vibration of 16 Hz to 150 Hz. The vibration transmitting medium of the transducers 29 is brought into contact with the body to feel the vibration of 16 Hz to 150 Hz (about C0 to D3 in the sound compass) in accordance with a piece of music. Simultaneously, it is possible to hear the sound output from the speakers 23 and 25

Figure 10:
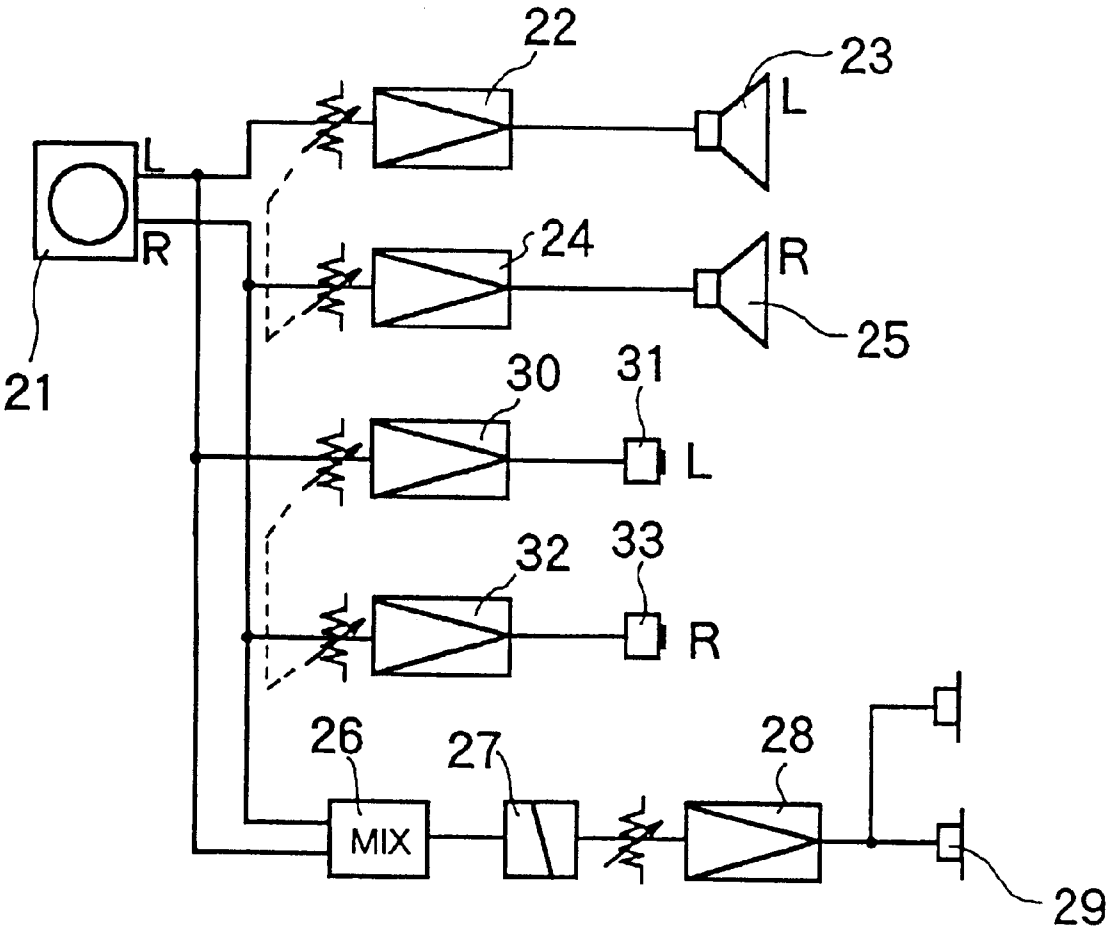
FIG. 10 is a view showing an example of the vibratory music apparatus for expressing a piece of vibratory music in accordance with the body sensible vibration and the sound output, in which two sound channels, two sound vibratory output channels and two body sensible vibration output channels are provided.

In the apparatus shown in FIG. 10, in order that mainly the auditory handicapped people may appreciate the Visic S in the apparatus shown in FIG. 9, the outputs L and R from the sound source 21 are inputted into the sound vibration amplifiers 30 and 32 to obtain the sound vibration outputs in the range of 20 Hz and 20 kHz from the transducers 31 and 33 for outputting the sound vibrations. In the same manner as in the apparatus of FIG. 9, the auditory handicapped people may feel the body sensible vibration through their bodies in the tangible vibratory manner, and simultaneously may feel the sound vibration output in the range of 20 Hz to 20 kHz in the tangible vibratory manner from the transducers 31 and 33 for outputting the sound vibrations to thereby feel both the body sensible vibration and the sound vibration. This apparatus is provided with the speakers 23 and 25 so as to be used by both the auditory handicapped people and the non-handicapped people.

EXAMPLE 4

FIG. 11 shows the apparatus in which mainly the auditory handicapped people may appreciate the Visic in the same manner as in Example 3. The difference between Example 3 and Example 4 is that the sound vibration channel is mono. The signal from the sound source 21 is inputted into the mixer 34, and the output thereof is obtained by the sound amplifier 35 and inputted into the transducer 36 for outputting the sound vibration to obtain the sound vibration output in the range of 20 Hz to 20 kHz. The other is the same as Example 3.

In case of FIG. 11, the sound vibration is the mono signal obtained by mixing the signals L and R and the sound vibration output is mono (1*ch*). This is advantageous in that the system may be simplified and in addition the user may concentrate his or her nerve for distinguishing the acoustic sound in the tangible vibration manner.

EXAMPLE 5

Examples 5 to 8 are related to the apparatus for the Visic S corresponding to the case 2.

Figure 12:
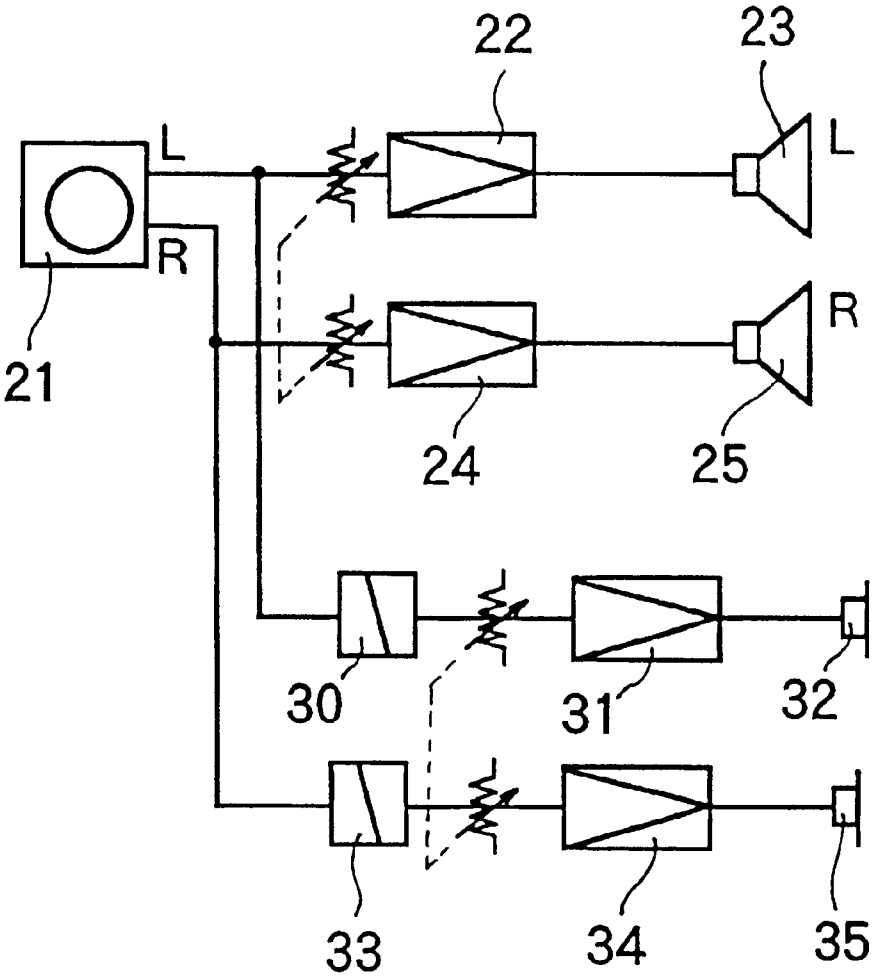
FIG. 12 is a view showing an example of the vibratory music apparatus for expressing a piece of vibratory music in accordance with the body sensible vibration and the sound output, in which two sound channels, and two body sensible vibration output channels are provided.

In FIG. 12 showing Example 5, the outputs L and R from the sound source 21 are amplified by the sound amplifiers 22 and 24, respectively, to obtain the sound output in the range of 20 Hz to 20 kHz from the speakers 23 and 25. Also, the body sensible vibration signals are picked up through low pass filters 30 and 33 of $f_c$ 150 Hz from the L and R signals, respectively, and inputted into the amplifiers 31 and 34, and their outputs are inputted into the transducers 32 and 35 to obtain the body sensible vibrations in the range of 16 Hz to 150 Hz. The non-handicapped people may feel the vibrations in the body sensible vibration output 16 Hz to 150 Hz (about C0 to D3 in terms of the sound compass) of the transducers 32 and 35 through the backrest and the seat portion, and simultaneously may hear the sound outputs from the speakers 23 and 25.

EXAMPLE 6

Figure 13:
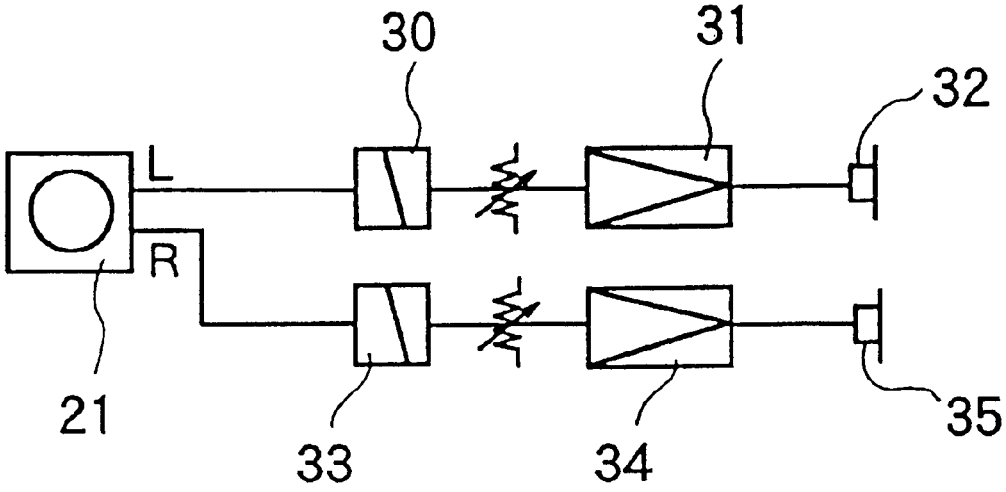
FIG. 13 is a view showing an example of the vibratory music apparatus only according to the body sensible vibration, in which the backrest and the seat portion are independent of each other.

FIG. 13 shows the system in which the output portions of the body sensible vibration is separated into the backrest and the seat portion in the case where the case 2 of the Visic V is expressed by the body sensible vibration output. The outputs L and R from the CD player 21 are inputted into the low pass filters 30 and 33, the signals of 16 Hz to 150 Hz (C0 to D3 in the sound range) are picked up from the outputs, and the signals are amplified by the amplifiers 28 through the volume adjustment to obtain the body sensible vibration outputs of the backrest 32 and the seat portion 35. Also, in this case, in the same manner as in Example 1, the user may appreciate the Visic only by the body sensible vibrations. The low pass filters 30 and 33 may be dispensed with.

EXAMPLE 7

In the apparatus shown in FIG. 14, in order that the auditory handicapped people may appreciate the Visic S in the apparatus shown in FIG. 12 (Example 6), the outputs L and R from the sound source 21 are inputted into the sound vibration amplifiers 30 and 32 to obtain the sound vibration outputs in the range of 20 Hz to 20 kHz from the transducers 31 and 33 for outputting the sound vibrations (for example, from the vibration output terminal S of FIG. 5). As a result, it is possible for the auditory handicapped people to appreciate and distinguish the sound vibrations in the range of 20 Hz to 20 kHz in the tangible sensitive manner with the finger tips or the like instead of the acoustic sound (sound) emitted from the speakers.

In the apparatus shown in FIG. 14, since there are provided the sound amplifiers 22 and 24 and the speakers 23 and 25 in addition to the above-described sound vibration outputs, both the auditory handicapped people and the non-handicapped people may also appreciate the Visic S.

Since this apparatus is the case 2, the backrest (L) and the seat portion (R) of the body sensible vibration are independent and there are provided the body sensible vibration amplifiers 36 and 38 and the transducers 37 and 39 for outputting the body sensible vibration.

EXAMPLE 8

Figure 15:
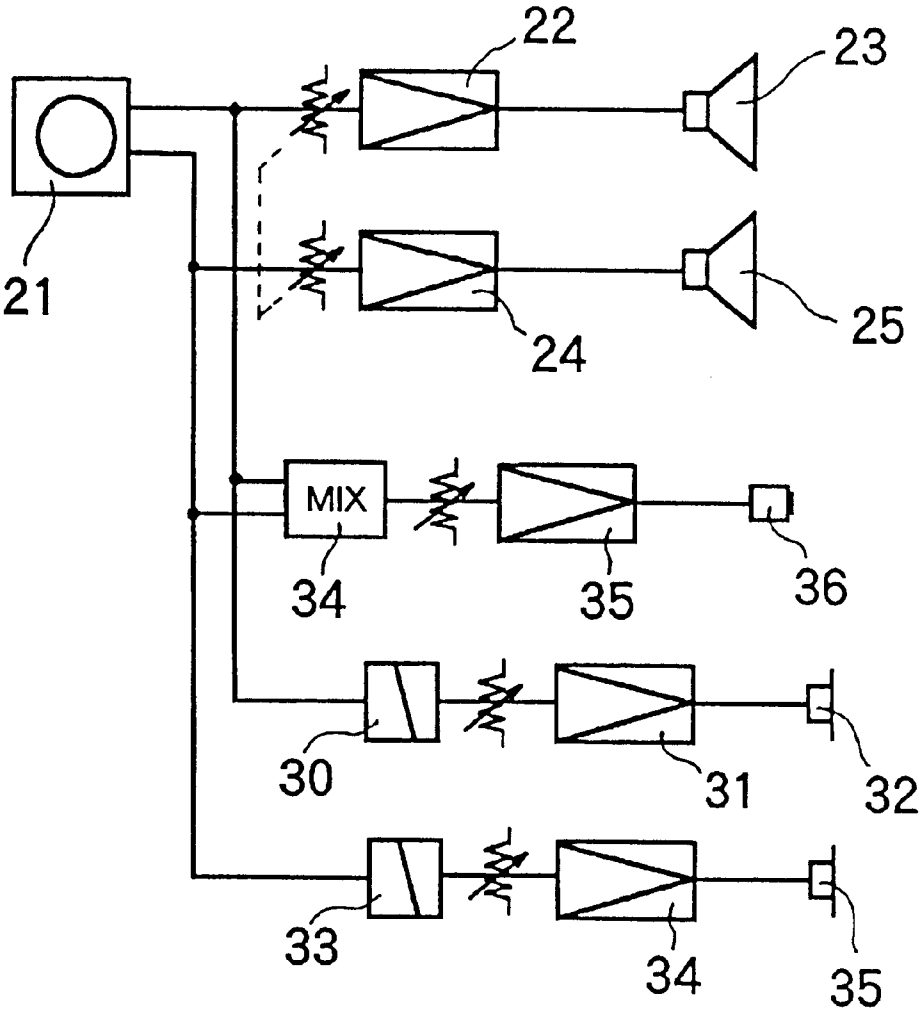
FIG. 15 is a view showing an example of the vibratory music apparatus for expressing a piece of vibratory music in accordance with the body sensible vibration and the sound output, in which two sound channels, one sound vibratory output channel and two body sensible vibration output channels are provided.

FIG. 15 shows the apparatus in which the sound vibration channel is mono in the apparatus in FIG. 14 (Example 7) for the auditory handicapped people. How to pick up the body sensible vibration is the same as in Example 5, and how to pick up the sound vibration outputs is the same as in Example 7.

As described above, the reclining seat 1 into which the transducers 5 are assembled is used in order to cause the vibration to be felt directly. However, in order to simply cause the vibration to be felt directly, it is sufficient to bring into contact with the body a handy container for containing the transducer 5. Also, in the case where the floor surface of the room is plate lined, the transducers 5 are fixed to the floor surface so that the vibrations according to the music are transmitted from the floor surface and the people may feel directly the vibrations. Incidentally, only by laying the handy container containing the transducers 5 in the vicinity of the people sitting on the floor surface, the people may obtain the body sensible vibrations.

As described above, the body sensible vibrations can be obtained. In comparison with the conventional music, the Visic has the following features.

First of all, the music is art according to sound, whereas the Visic is art according to the body sensible vibration. Also, the music expresses the beauty that appeals to the human auditory sense by the combination of strength, length, frequency, tone, chord and the like of the sound in accordance with a constant theory, whereas the Visic expresses the beauty appealing to the tangible vibration sense of the body in combination, based upon a constant theory, of strength, length, frequency, waveform, overlap and the like of the body sensible vibration. A factor for working to the physiologic sense of the human being is remarkable in the vibratory music, i.e., Visic, and it is easy to obtain a sense of relaxation, ecstasy or intoxication. Also, the Visic has a characteristic that it appears to the root of the human being.

A huge number of pieces of art of music have been produced in the long history thereof, and expression manners expanding in the wide range have been established. In contrast thereto, the Visic is in the stage in which the method for expressing it has been discovered. The number of pieces of Visic is small and it is hard to say that the expression method has been established.

With respect to people to enjoy, the music is for the non-handicapped people and it is impossible for the auditory handicapped people to appreciate the music in general but the Visic may be enjoyed by both the auditory handicapped people and the non-handicapped people.

With respect to the ordinary music, there are various opinions in the auditory psychology and music psychology. In addition thereto, with respect to the Visic, there are many reports of the effects on pain control from the aspects of the vibratory psychology and physiology, the precaution of the decubitus, constipation or the like.

Turning to the basic wave components with respect to the signal (musical sound), the basic wave components of the musical sound are low, and in many cases, one having a large amount of overtone component is used. This tendency is remarkable in the low sound compass due to the characteristics of the musical instrument. In contrast thereto, in many cases, the basic wave components are used for the signal of the body sensible vibration.

With respect to the sound compass, the sound compass of the piano that is the conventional typical musical instrument with eighty-eight keys has the sound compass from 27.50 Hz of $A_0$ to 4186.0 Hz of $C_8$, (theoretically defined as the musical sound from 16.351 Hz of $C_0$ to 16744 Hz $C_{10}$), whereas the compass from about 16 Hz to 150 Hz is used for the Visic. The body sensible vibration in the compass from 16.351 Hz ($C_0$) to 48.999 Hz ($G_1$) has a high effect for the physiological comfort, deep ecstasy and intoxication.

The present invention provides the following advantages to the conventional music with the above-described structure.

The music expresses the beauty that appeals to the human auditory sense by the combination of strength, length, frequency, tone, chord and the like of the sound in accordance with a constant theory, whereas the Visic expresses the beauty appealing to the tangible vibration sense of the body in combination, based upon a constant theory (musical composition theory like musical scale ,harmonics ,rhythm or the like ) of strength, length, frequency, waveform, overlap and the like of the body sensible. A factor for working to the physiologic sense of the human being is remarkable in the vibratory music, and it is easy to obtain a sense of relaxation, ecstasy and intoxication.

In case of appreciation, the object for the music is mainly for the non-handicapped people and it is hard for the auditory handicapped people to enjoy the music, but the Visic may be enjoyed by the auditory handicapped people and the non-handicapped people. In addition to the aspects of the auditory psychology and music psychology, there are many reports of the effects on pain control from the aspects of the vibratory psychology and physiology, the precaution of the decubitus, constipation or the like.

As described above, with respect to the sound compass, the sound compass of the piano that is the conventional typical musical instrument with eighty-eight keys has the sound compass from 27.50 Hz of $A_0$, to 4186.0 Hz of $C_8$ (theoretically defined as the musical sound from 16.351 Hz of $C_0$ to 16744 Hz $C_{10}$), whereas the compass from about 16

Hz to 150 Hz is used for the Visic. The body sensible vibration in the compass from 16.351 Hz ($C_0$) to 48.999 Hz ($G_1$) has a high effect on the physiological comfort, deep ecstasy and intoxication.

In the case where the transducer is assembled into a chair, a bed or the like or into a handy container as media for the body sensible vibration, the flexibility of the place of installation is enhanced. In this case, a plurality of transducers to be brought into contact with the body may be vibrated so as to have a part of each piece of music. The vibration is received through the body as a whole. Accordingly, it is possible to support the enlargement of the vibratory image.

If the conventional chair, bed or the like is utilized for assembling the transducers, it is possible to easily enjoy the body sensible vibration in daily life.

In the case where the vibration is sensed through the transducers and the sound through the ears from the speakers is simultaneously used to stimulate the sensitivity, it is possible to assist the enlargement of the vibratory image.

The musical signal for vibration that is abundant in the musical property by using well the sound in the low sound compass in the vicinity of C0 to D3 of the musical level is produced, and the transducers are vibrated in accordance with the vibratory musical signals so as to impart the vibration directly to the body. Thus, it is possible to obtain a new sense that expresses the vibration as a piece of music. Accordingly, it is recognized by the auditory handicapped people that the vibration is available as a piece of music, and they can argue music.

What is claimed is:

1. A vibratory music apparatus comprising:

a support having a first portion adapted to support a torso of a user, a second portion adapted to support a head of the user, and a third portion adapted to support a leg of the user;

at least one vibratory transducer carried by said support that can output mechanical vibrations at frequencies related to frequencies of an audio signal;

at least one audio output speaker carried by said second portion;

at least one leg vibratory transducer carried by said third portion that can output mechanical vibrations to the user's leg; and a further leg vibratory transducer;

whereby said at least one leg vibratory transducer outputs vibrations in a third frequency range and said further leg vibratory transducer outputs vibrations in a fourth frequency range different from the third frequency range.

2. The vibratory music apparatus according to claim 1, wherein a frequency range of the vibrations output by said at least one vibratory transducer spans about three overtones.

3. The vibratory music apparatus as claimed in claim 1 wherein the vibrations output by said at least one vibratory transducer span a frequency range from about 16 Hz to 150 Hz.

4. The vibratory music apparatus as claimed in claim 3 wherein the vibrations output by said at least one vibratory transducer span a frequency range from about 16 Hz to 50 Hz.

5. The vibratory music apparatus according to claim 1, wherein said apparatus comprises a further audio output speaker whereby said at least one audio output speaker can output a first audio signal from a first channel of a multi-channel signal; and said further audio output speaker can output a second audio signal from a second channel of the multi-channel signal.

6. The vibratory music apparatus as claimed in claim 1 wherein said at least one vibratory transducer is carried by said first portion such that said vibratory transducer can output mechanical vibrations to the user's torso.

7. The vibratory music apparatus according to claim 6, wherein said apparatus further comprises a further torso transducer carried by said first portion whereby said at least one vibratory transducer outputs vibrations in a first frequency range and said further torso transducer outputs vibrations in a second frequency range different from the first frequency range.

8. The vibratory music apparatus according to claim 1, further comprising a further vibratory transducer carried by said support, wherein:

said at least one vibratory transducer can output vibrations from a first channel of a multi-channel signal; and said further vibratory transducer can output vibrations from a second channel of said multi-channel signal.

9. The vibratory music apparatus according to claim 1 wherein the support further comprises a fourth portion adapted to support an arm of a user, the apparatus further comprising at least one fingertip vibratory transducer carried by said fourth portion that can output mechanical vibrations to the user's fingertips.

10. The vibratory music apparatus according to claim 9, wherein said at least one fingertip vibratory transducer outputs mechanical vibrations having a frequency range from about 20 Hz to 20 KHz.

11. The vibratory music apparatus according to claim 10, further comprising a further fingertip vibratory transducer whereby said at least one fingertip vibratory transducer outputs vibrations from a first channel of a multi-channel signal; and said further fingertip vibratory transducer outputs vibrations from a second channel of said multi-channel signal.

12. A vibratory music apparatus comprising:

an input terminal to which an input audio signal can be connected;

a bandpass filter having an input and an output with a pass band of about 16 Hz to 150 Hz, said input thereof being connected to said input terminal;

a first amplifier having an input and an output, said input thereof being connected to said input terminal;

a second amplifier having an input and an output, said input thereof being connected to said output of said bandpass filter;

an audio speaker connected to said output of said first amplifier;

a vibratory transducer connected to said output of said second amplifier;

wherein the input audio signal is a stereo signal having first and second channels, said apparatus further comprising:

a further input terminal;

a mixer having first and second inputs connected to corresponding ones of said input terminal and said further input terminal, and an output thereof connected to said input of said bandpass filter; and a further first amplifier having an input and an output, said input thereof being connected to said further input terminal and an output thereof connected to a further audio speaker;

a third amplifier having an input and an output, said input thereof connected to said input terminal; and an audio frequency vibratory transducer connected to said output of said third amplifier.

13. The vibratory music apparatus as claimed in claim 12 further comprising:

a further third amplifier having an input and an output, said input thereof connected to said further input terminal; and a further audio frequency vibratory transducer connected to said output of said further third amplifier.

14. The vibratory music apparatus as claimed in claim 12 further comprising:

a mixer having first and second inputs connected to corresponding ones of said input terminal and said further input terminal, and an output thereof connected to said audio frequency vibratory transducer.

* * * * *